US010135132B2

(12) United States Patent
Mao et al.

(10) Patent No.: US 10,135,132 B2
(45) Date of Patent: Nov. 20, 2018

(54) ANTENNA EQUIPMENT AND TERMINAL

(71) Applicant: Huawei Technologies Co., Ltd., Shenzhen (CN)

(72) Inventors: Zhengyan Mao, Wuhan (CN); Kemeng Wang, Wuhan (CN); Dejin Zhu, Shenzhen (CN); Xiaoping Gao, Wuhan (CN); Yiwen Gong, Mountain View, CA (US); Song Wu, Wuhan (CN); Wei Wang, Wuhan (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 15/540,914

(22) PCT Filed: Dec. 30, 2014

(86) PCT No.: PCT/CN2014/095697

§ 371 (c)(1),
(2) Date: Jun. 29, 2017

(87) PCT Pub. No.: WO2016/106612

PCT Pub. Date: Jul. 7, 2016

(65) Prior Publication Data

US 2017/0338552 A1 Nov. 23, 2017

(51) Int. Cl.
*H01Q 1/48* (2006.01)
*H01Q 1/52* (2006.01)
(Continued)

(52) U.S. Cl.
CPC ..... *H01Q 1/48* (2013.01); *H01Q 1/52* (2013.01); *H01Q 3/00* (2013.01); *H01Q 1/243* (2013.01); *H01Q 1/38* (2013.01)

(58) Field of Classification Search
CPC ..... H01Q 1/48; H01Q 3/00
(Continued)

(56) References Cited

U.S. PATENT DOCUMENTS 6,424,300 B1 7/2002 Sanford et al.
2010/0045552 A1* 2/2010 Ueki ..... H01Q 1/243 343/745

(Continued)

FOREIGN PATENT DOCUMENTS

CN 202025847 U 11/2011
CN 102349196 A 2/2012

(Continued)

*Primary Examiner* — Andrea Lindgren Baltzell
(74) *Attorney, Agent, or Firm* — Leydig, Voit & Mayer, Ltd.

(57) ABSTRACT

An antenna equipment includes an antenna and a board on which the antenna is disposed, and includes an area that is disposed on the board and that is not covered by a metal layer. A first edge of the board is a longer edge of the board in two edges of the board that are close to the antenna, a point that is on the first edge and whose distance with a current maximum point on the first edge is λ/4 is a first point, the current maximum point is on the first edge and that is closest to a feed point of the antenna, and λ is an operating wavelength of the antenna. The area that is not covered by a metal layer includes the first point, and a maximum distance from an edge of the area to the first edge of the board is λ/4.

16 Claims, 3 Drawing Sheets

(51) Int. Cl.
*H01Q 3/00* (2006.01)
*H01Q 1/24* (2006.01)
*H01Q 1/38* (2006.01)

(58) Field of Classification Search
USPC ..... 343/846
See application file for complete search history.

(56) References Cited

U.S. PATENT DOCUMENTS

| | | | | |
|---|---|---|---|---|
| 2011/0156972 | A1* | 6/2011 | Korva ..... | H01Q 1/273 343/745 |
| 2012/0007783 | A1 | 1/2012 | Taura | |
| 2012/0229360 | A1 | 9/2012 | Jagielski et al. | |

FOREIGN PATENT DOCUMENTS

| | | | |
|---|---|---|---|
| CN | 102571126 | A | 7/2012 |
| EP | 0548975 | B1 | 6/1997 |
| JP | 2006115182 | A | 4/2006 |
| WO | 2006114477 | A1 | 11/2006 |
| WO | 2011154954 | A2 | 12/2011 |

* cited by examiner

ANTENNA EQUIPMENT AND TERMINAL

CROSS-REFERENCE TO RELATED APPLICATIONS

This application is a national stage of International Application No. PCT/CN2014/095697, filed on Dec. 30, 2014, which is hereby incorporated by reference in its entirety.

TECHNICAL FIELD

The present invention relates to the communications field, and in particular, to antenna equipment and a terminal.

BACKGROUND

Performance of existing antenna equipment (an antenna is disposed on a board) is ordinary, and a pattern of the existing antenna equipment is easily affected by a direction impact of a "ground" current on an edge of the board, especially on a board edge close to an area in which the antenna is located. A longer edge of the board indicates a greater direction impact of the "ground" current on the edge.

Exemplarily, if an antenna is disposed in a lower right corner of a board, because of direction impacts of "ground" currents on two edges (especially a longer edge of the board) of the board that are close to an area in which the antenna is located on the board, a side lobe is generated in a pattern of antenna equipment, and a main lobe and the side lobe of the pattern are shifted upward-leftward. The pattern of the antenna equipment is affected, and accuracy of a transmit direction of the antenna equipment is also affected.

SUMMARY

Embodiments of the present invention provide antenna equipment and a terminal that can suppress a direction impact of a "ground" current on an edge of a board on which an antenna is located, which improves a pattern of the antenna equipment and performance of a transmit direction of the antenna equipment.

To achieve the foregoing objective, technical solutions used in the embodiments of the present invention are follows:

According to a first aspect, antenna equipment is disclosed, including: an antenna and a board on which the antenna is disposed; and further including: a first area that is disposed on the board and that is not covered by a metal layer; where a first edge of the board is a longer edge of the board in two edges of the board that are close to the antenna, a point that is on the first edge and whose distance with a first current maximum point on the first edge is $\lambda/4$ is a first point, the first current maximum point is a current maximum point that is on the first edge and that is closest to a feed point of the antenna, and $\lambda$ is an operating wavelength of the antenna; and the first area that is not covered by a metal layer includes the first point, and a maximum distance from an edge of the first area to the first edge of the board is $\lambda/4$.

With reference to the first aspect, in a first possible implementation manner of the first aspect, the antenna equipment further includes a second area that is disposed on the board and that is not covered by a metal layer;

a second edge of the board is a shorter edge of the board in the two edges of the board that are close to the antenna, a point that is on the second edge and whose distance with a second current maximum point on the second edge is $\lambda/4$ is a second point, and the second current maximum point is a current maximum point that is on the second edge and that is closest to the feed point of the antenna; and the second area that is not covered by a metal layer includes the second point, and a maximum distance from an edge of the second area to the second edge of the board is $\lambda/4$.

With reference to the first aspect or the first possible implementation manner of the first aspect, in a second possible implementation manner of the first aspect, an adjustable component is further disposed in the first area, where the adjustable component is an inductor or an adjustable capacitor.

With reference to the first aspect, the first possible implementation manner of the first aspect, or the second possible implementation manner of the first aspect, in a third possible implementation manner of the first aspect, the adjustable component is further disposed in the second area.

According to a second aspect, a terminal is disclosed, where the terminal includes antenna equipment; and the antenna equipment is the antenna equipment according to the first aspect in the foregoing technical solutions.

The present invention provides a terminal and antenna equipment that includes a board, an antenna area, and a first area. The first area is an area without being covered by copper and includes a first point. A distance from the first point to a current maximum point closest to a feed point of an antenna is $\lambda/4$, and a distance from a highest point of the first area to a first edge (that is, an edge that is on the board and that includes the first point and the current maximum point closest to the feed point of the antenna) is $\lambda/4$. Because an oscillation current reverses direction at a current zero closest to a current maximum point and a distance from the current maximum point to the closest current zero is $\lambda/4$, the current begins to reverse direction at the first point. Because directions of currents on edges of the first area are opposite, magnetic fields of opposite directions are generated. Therefore, a direction impact of the current on the first edge is weakened, a pattern of the antenna equipment is improved, and performance of a transmit direction of the antenna equipment is improved.

BRIEF DESCRIPTION OF DRAWINGS

To describe the technical solutions in the embodiments of the present invention or in the prior art more clearly, the following briefly describes the accompanying drawings required for describing the embodiments or the prior art. Apparently, the accompanying drawings in the following description show merely some embodiments of the present invention, and a person of ordinary skill in the art may still derive other drawings from these accompanying drawings without creative efforts.

DESCRIPTION OF EMBODIMENTS

The following clearly and completely describes the technical solutions in the embodiments of the present invention with reference to the accompanying drawings in the embodiments of the present invention. Apparently, the described embodiments are merely some but not all of the embodiments of the present invention. All other embodiments obtained by a person of ordinary skill in the art based on the embodiments of the present invention without creative efforts shall fall within the protection scope of the present invention.

Figure 1:
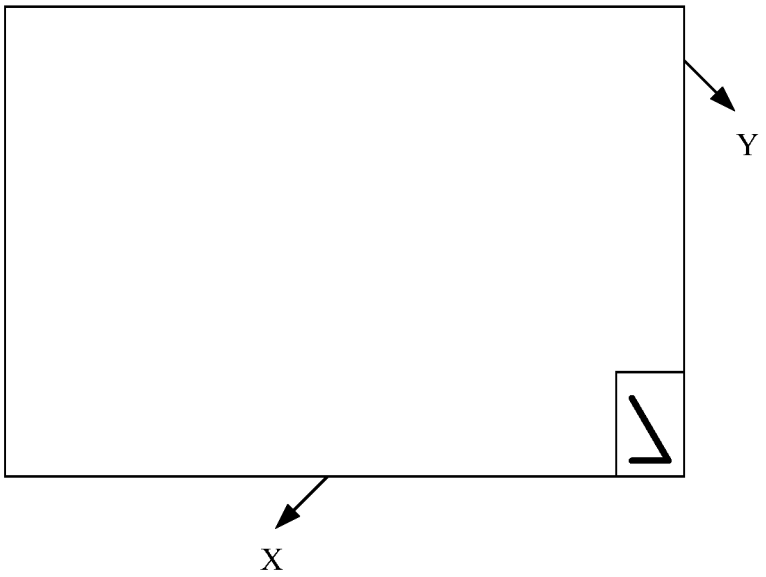
FIG. 1 is existing antenna equipment.

FIG. 1 shows existing antenna equipment. The board is a PCB (Printed Circuit Board, printed circuit board), an antenna is disposed in a lower right corner of the PCB board, two edges of the board that are close to the antenna have greater impacts on a pattern of the antenna, and a direction impact on the pattern that is caused by a longer edge X of the board is greater than a direction impact on the pattern that is caused by a shorter edge Y of the board. Specifically, when a length of a board edge is within 3/2λ, a direction impact of an edge "ground" current is directly proportional to the length of the edge. However, when the length of the board edge exceeds 3/2λ, though the length of the edge increases, the direction impact of the edge "ground" current does not change greatly. Certainly, the board may be a metal plate, which is not limited herein.

Figure 2:
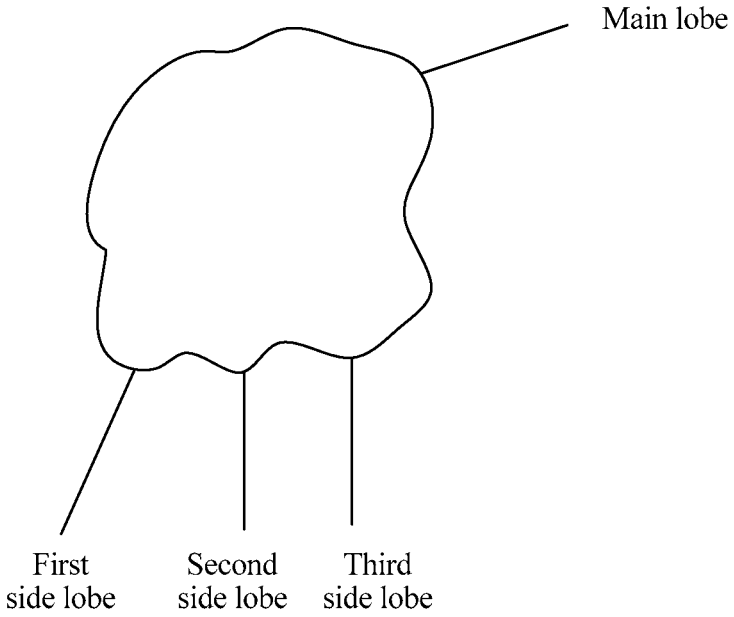
FIG. 2 is a pattern of existing antenna equipment on an X-Y plane.

FIG. 2 shows an antenna pattern on an X-Y plane. Referring to FIG. 1 and FIG. 2, it can be learned that because of a direction impact of a current on the edge X of the board, a first side lobe, a second side lobe, and a third side lobe are generated in the pattern of the antenna, and a main lobe and the side lobes of the antenna pattern are caused to radiate leftward. Energy of the main lobe is the strongest, energy of the first side lobe is the second strongest, and compared with the energy of the first side lobe, energy of the second side lobe and energy of the third side lobe decrease in a geometrical ratio. By comparison, the energy of the second side lobe and the energy of the third side lobe are far less than that of the first side lobe, and therefore, energy of the side lobes of the antenna pattern may be greatly decreased only by suppressing the first side lobe, thereby improving performance of the antenna equipment.

Embodiment 1

Figure 3:
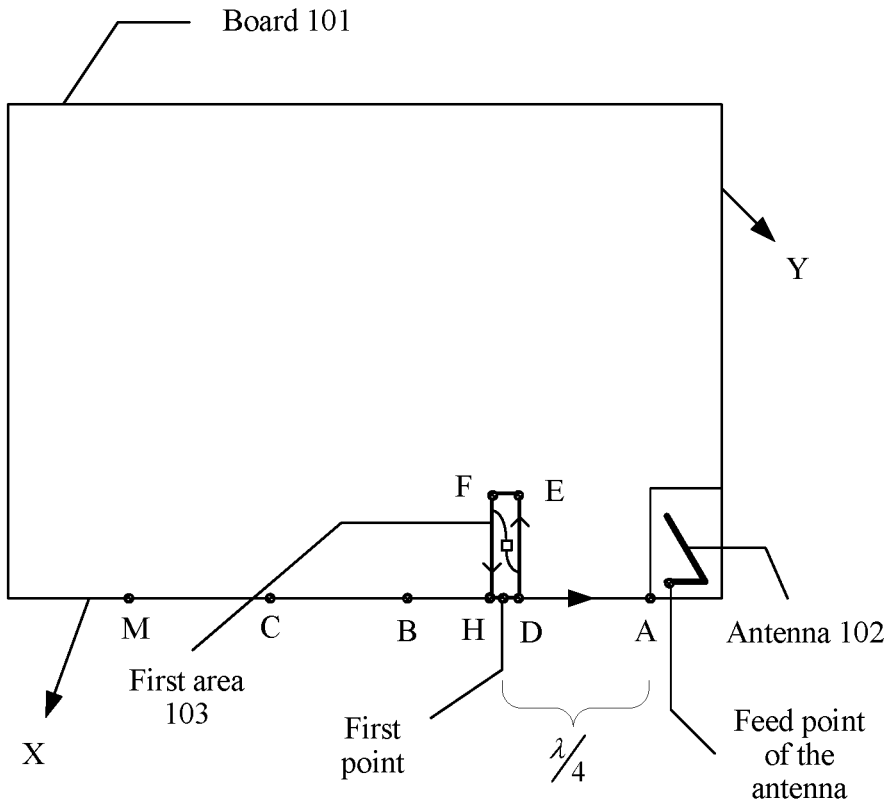
FIG. 3 is a schematic structural diagram of antenna equipment according to the present invention.

This embodiment of the present invention provides antenna equipment. As shown in FIG. 3, the antenna includes: a board 101, an antenna 102 disposed on the board, and a first area 103 that is disposed on the board 101 and that is not covered by a metal layer. Understandably, an area in which the antenna 102 is located is a headroom area, and a projection area (an area enclosed by a solid line in a lower right corner) of the antenna 102 on the board 101 is not covered by a metal layer.

A first edge X of the board 101 is a longer edge of the board in two edges of the board that are close to the antenna. A point that is on the first edge X and whose distance with a first current maximum point A on the first edge X is λ/4 is a first point, and the first current maximum point A is a current maximum point that is on the first edge and that is closest to a feed point of the antenna, where λ is an operating wavelength of the antenna 102. The board 101 may be a PCB board or a metal plate. It should be noted that a wavelength of an electromagnetic wave corresponds to a frequency, for example, 2.4 GHz, and a center frequency 2.45 GHz is selected. Because λ*f=C, where f represents a frequency, and C represents the speed of light in a vacuum, when f=2.4 GHz is substituted into λ*f=C, it may be obtained by calculation that λ is around 122 mm, and λ/4 is around 30.5 mm (this value is a wavelength in a vacuum, and in reality, a wavelength of propagation in a board is less than the value).

The first area 103 that is not covered by a metal layer includes the first point, and a maximum distance from an edge (FE) of the first area 103 to the first edge X of the board is λ/4. Optionally, an adjustable component may further be disposed in the first area 103, where the adjustable component is an inductor or an adjustable capacitor, and a width of the first area 103 should accommodate the adjustable component or be greater than or equal to 3 mm.

Figure 4:
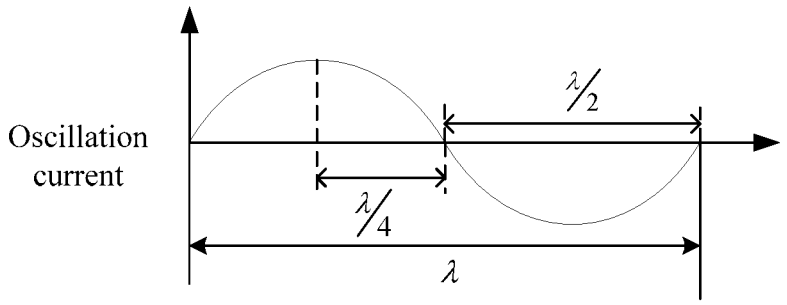
FIG. 4 is a schematic waveform diagram of an oscillation current.

It should be noted that there exist four points A, B, C, and M of weakest electric field strength on the edge X of the board, and distances from A to B, B to C, and C to M are λ/2. Because of A, B, and C, three side lobes are generated. Specifically, because the edge X of the board corresponds to three λ/2s, three lobes are generated. That is, generation of a first side lobe, a second side lobe, and a third side lobe is respectively caused by three points A, B, and C of weakest electric field strength (that is, points of zero electric field strength) on the edge X of the board (that is, the first edge). In an electromagnetic field, specific to a point, if electric field strength of the point is zero, magnetic field strength of the point is the strongest, and a current is the greatest. Therefore, the four points A, B, C, and M are all current maximums. Referring to FIG. 3, it can be learned that A is a current maximum point that is closest to the feed point of the antenna. Referring to FIG. 4, an oscillation current reverses direction after passing every λ/2 (a current reverses direction at a current zero), a distance from a current maximum point to a closest current zero is λ/4, that is, a current of a current zero adjacent to the current maximum point reverses direction, and a distance between a point D and the first point may be ignored, and therefore the current reverses direction at the first point. Therefore, it is considered that the current begins to reverse direction from the point D, and in addition, the current begins to reverse direction from a point F. It should be noted that reversing directions of currents on an FH edge and an ED edge are caused by notching, and if H, F, E, and D are arranged in a line, the currents are still codirectional currents. Exemplarily, a direction of a current from the point A to the point D is rightward, the current begins to reverse direction from the point D, a direction of the current from the point D to a point E is upward, and a direction of the current from the point F to a point H is downward. Because currents of two edges (that is, a DE edge and an FH edge) of the first area 103 are opposite, directions of generated magnetic fields are opposite, and the generated magnetic fields cancel each other. Therefore, a direction impact of a current on the first edge is weakened, the first side lobe is suppressed, and a degree of leftward radiation of the main lobe and the side lobes of the antenna pattern is also decreased.

In addition, because the width of the first area 103 is far less than λ/4, it is considered that a distance from the point A to the point D plus a distance from the point D to the E point approximately equals λ/2. Because a maximum distance from an edge of the first area 103 to the first edge of the board is λ/4 and the width of the first area is far less than λ/4, a length of a path between the point F and the point A also approximately equals λ/2.

It should be noted that an adjustable component (for example, an adjustable capacitor or an adjustable inductor) is disposed in the first area 103, so as to implement intelligent scanning of the pattern. Specifically, intelligent control on the pattern is performed by using an adjustable capacitor, or an adjustable inductor, or an inductor selected by switching a switch. Great inductance brings an open circuit blocking effect on a high frequency signal, and equates to notching; and a "0pf" capacitor may equate to an open circuit or notching. In addition, the board 101 may be a PCB, a metal plate, or the like. A shape of the first area 103 may not be a regular shape shown in FIG. 3, and an irregular structural shape may be used, which is not limited herein.

The present invention provides an antenna that includes a board, an antenna area, and a first area. The first area is an area without being covered by copper and includes a first point. A distance from the first point to a current maximum point closest to a feed point of the antenna is λ/4, and a distance from a highest point of the first area to a first edge (that is, an edge that is on the board and that includes the first point and the current maximum point closest to the feed point of the antenna) is λ/4. Because an oscillation current reverses direction at a current zero closest to a current maximum point and a distance from the current maximum point to the closest current zero is λ/4, the current begins to reverse direction at the first point. Because directions of currents on edges of the first area are opposite, magnetic fields of opposite directions are generated. Therefore, a direction impact of the current on the first edge is weakened, a pattern of antenna equipment is improved, and performance of a transmit direction of the antenna equipment is improved.

Embodiment 2

Figure 5:
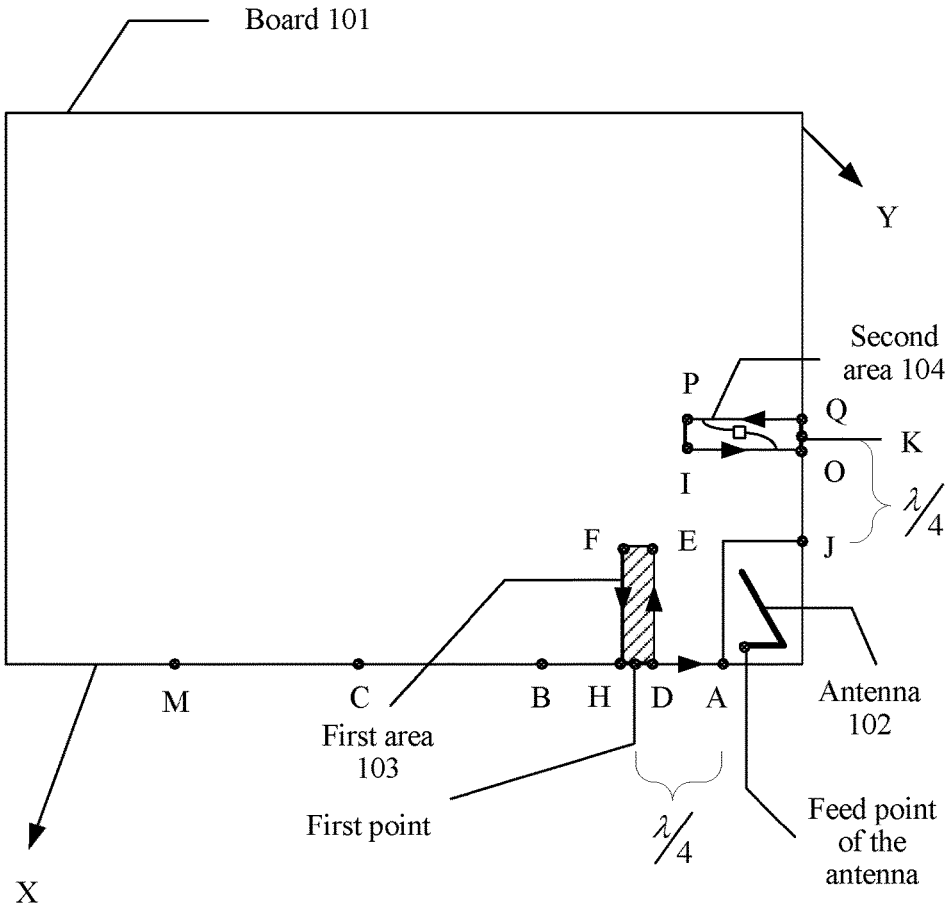
FIG. 5 is another schematic structural diagram of antenna equipment according to the present invention.

This embodiment of the present invention provides antenna equipment. As shown in FIG. 5, in addition to the board 101, the antenna 102 disposed on the board, and the first area 103 that is disposed on the board and that is not covered by a metal layer in the foregoing embodiment, the antenna equipment further includes a second area 104 that is disposed on the board and that is not covered by a metal layer.

A first edge X of the board 101 is a longer edge of the board in two edges of the board that are close to the antenna. A point that is on the first edge X and whose distance with a first current maximum point on the first edge is λ/4 is a first point, and the first current maximum point A is a current maximum point that is on the first edge and that is closest to a feed point of the antenna, where λ is an operating wavelength of the antenna 102. It should be noted that a wavelength of an electromagnetic wave corresponds to a frequency, for example, 2.4 GHz, and a center frequency 2.45 GHz is selected. Because λ*f=C, where f represents a frequency, and C represents the speed of light in a vacuum, when f=2.4 GHz is substituted into λ*f=C, it may be obtained by calculation that λ is around 122 mm, and λ/4 is around 30.5 mm.

The first area 103 that is not covered by a metal layer includes the first point, and a maximum distance from an edge of the first area to the first edge X of the board is λ/4. Optionally, an adjustable component may further be disposed in the first area 103, where the adjustable component is an inductor or an adjustable capacitor, and a width of the first area 103 should accommodate the adjustable component or be greater than or equal to 3 mm.

A second edge Y of the board is a shorter edge of the board in the two edges of the board that are close to the antenna, a point that is on the second edge Y and whose distance with a second current maximum point J on the second edge Y is λ/4 is a second point, and the second current maximum point J is a current maximum point that is on the second edge Y and that is closest to the feed point of the antenna. As shown in FIG. 5, a point K is the second point.

The second area 104 that is not covered by a metal layer includes the second point, and a maximum distance from an edge of the second area 104 to the second edge of the board is λ/4. Optionally, an adjustable component may further be disposed in the second area, where the adjustable component is an inductor or an adjustable capacitor, and a width of the second area should accommodate the adjustable component or be greater than or equal to 3 mm.

Referring to description in Embodiment 1, directions of currents on two edges (that is, an edge 10 and an edge PQ, as shown in FIG. 5) of the second area 104 are opposite, and as a result, magnetic fields of opposite directions are generated. Therefore, a direction impact of the current on the second edge is weakened, an upward radiation capability of a pattern of the antenna is decreased, and a downward-rightward radiation capability of the antenna pattern is enhanced.

It should be noted that an adjustable component (for example, an adjustable capacitor or an adjustable inductor) is disposed in the first area 103 or the second area 104, so as to implement intelligent scanning of the pattern. Exemplarily, as shown in FIG. 3, the adjustable component may be connected between FH and ED, or may be connected between FE and HD. As shown in FIG. 5, the adjustable component may be connected between PQ and IO, or may be connected between PI and QO. Specifically, intelligent control on the pattern is performed by using an adjustable capacitor, or an adjustable inductor, or an inductor selected by switching a switch. Great inductance brings an open circuit blocking effect on a high frequency signal, and equates to notching; and a "0pf" capacitor may equate to an open circuit or notching.

The present invention provides antenna equipment that includes a board, an antenna area, a first area, and a second area. The first area is an area without being covered by copper and includes a first point. A distance from the first point to a current maximum point closest to a feed point of an antenna is λ/4, and a distance from a highest point of the first area to a first edge (that is, an edge that is on the board and that includes the first point and the current maximum point closest to the feed point of the antenna) is λ/4. Because an oscillation current reverses direction at a current zero closest to a current maximum point and a distance from the current maximum point to the closest current zero is λ/4, the current begins to reverse direction at the first point. Because directions of currents on edges of the first area are opposite, magnetic fields of opposite directions are generated. Therefore, a direction impact of the current on the first edge is weakened, and a side lobe of a pattern of the antenna is suppressed. Similarly, directions of currents on edges of the second area are also opposite, and magnetic fields of opposite directions are generated. Therefore, a direction impact of the current on the second edge is weakened, a rightward radiation capability of the antenna pattern is enhanced, and performance of the antenna equipment is improved.

In addition, in a traditional intelligent antenna solution, multiple antennas are used and distributed in all corners, and intelligent control on a pattern is implemented by switching a switch to select an antenna. However, in embodiments of the present invention, intelligent control on a pattern may be implemented only by using an adjustable opponent to control, specific to a single antenna, an area (the foregoing first area or second area) of a corresponding location, which has an obvious advantage in development efficiency and performance. The antenna does not need to be manually installed or operated, and appearance of a product is not affected (a commonly used metal steel plate antenna needs a height. However, in a case of the present invention, neither an antenna nor an area without being covered by a metal layer on a board needs a height), thereby having characteristics of low costs and remarkable performance.

The foregoing descriptions are merely specific implementation manners of the present invention, but are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. Antenna equipment, comprising: an antenna and a board on which the antenna is disposed; and further comprising: a first area that is disposed on the board and that is not covered by a metal layer; wherein a first edge of the board is a longer edge of the board in two edges of the board that are close to the antenna, a point that is on the first edge and whose distance with a first current maximum point on the first edge is $\lambda/4$ is a first point, the first current maximum is a current maximum that is on the first edge and that is closest to a feed point of the antenna, and $\lambda$ is an operating wavelength of the antenna; and the first area that is not covered by a metal layer comprises the first point, and a maximum distance from an edge of the first area to the first edge of the board is $\lambda/4$.

2. The antenna equipment according to claim 1, wherein the antenna equipment further comprises a second area that is disposed on the board and that is not covered by a metal layer;

a second edge of the board is a shorter edge of the board in the two edges of the board that are close to the antenna, a point that is on the second edge and whose distance with a second current maximum point on the second edge is $\lambda/4$ is a second point, and the second current maximum point is a current maximum point that is on the second edge and that is closest to the feed point of the antenna; and the second area that is not covered by a metal layer comprises the second point, and a maximum distance from an edge of the second area to the second edge of the board is $\lambda/4$.

3. The antenna equipment according to claim 1, wherein an adjustable component is further disposed in the first area, and the adjustable component is an adjustable inductor or an adjustable capacitor.

4. The antenna equipment according to claim 1, wherein the adjustable component is further disposed in the second area.

5. The antenna equipment according to claim 1, wherein a current reverses direction at the first point.

6. The antenna equipment according to claim 1, wherein a width of the first area is greater than or equal to 3 mm.

7. The antenna equipment according to claim 2, wherein directions of currents on two edges of the second area are opposite.

8. The antenna equipment according to claim 2, wherein a width of the second area is greater than or equal to 3 mm.

9. A terminal, wherein the terminal comprises antenna equipment, and the antenna equipment comprising:

an antenna and a board on which the antenna is disposed; and further comprising: a first area that is disposed on the board and that is not covered by a metal layer; wherein a first edge of the board is a longer edge of the board in two edges of the board that are close to the antenna, a point that is on the first edge and whose distance with a first current maximum point on the first edge is $\lambda/4$ is a first point, the first current maximum is a current maximum that is on the first edge and that is closest to a feed point of the antenna, and $\lambda$ is an operating wavelength of the antenna; and the first area that is not covered by a metal layer comprises the first point, and a maximum distance from an edge of the first area to the first edge of the board is $\lambda/4$.

10. The terminal according to claim 9, wherein the antenna equipment further comprises a second area that is disposed on the board and that is not covered by a metal layer;

a second edge of the board is a shorter edge of the board in the two edges of the board that are close to the antenna, a point that is on the second edge and whose distance with a second current maximum point on the second edge is $\lambda/4$ is a second point, and the second current maximum point is a current maximum point that is on the second edge and that is closest to the feed point of the antenna; and the second area that is not covered by a metal layer comprises the second point, and a maximum distance from an edge of the second area to the second edge of the board is $\lambda/4$.

11. The terminal according to claim 9, wherein an adjustable component is further disposed in the first area, and the adjustable component is an adjustable inductor or an adjustable capacitor.

12. The antenna equipment according to claim 9, wherein the adjustable component is further disposed in the second area.

13. The antenna equipment according to claim 9, wherein a current reverses direction at the first point.

14. The antenna equipment according to claim 9, wherein a width of the first area is greater than or equal to 3 mm.

15. The antenna equipment according to claim 10, wherein directions of currents on two edges of the second area are opposite.

16. The antenna equipment according to claim 10, wherein a width of the second area is greater than or equal to 3 mm.

* * * * *